US007444953B1

(12) United States Patent
Player

(10) Patent No.: US 7,444,953 B1
(45) Date of Patent: Nov. 4, 2008

(54) REMOVABLE TRANSOM LIGHTS

(76) Inventor: Michael D. Player, 4151 Claussen Rd., Florence, SC (US) 29505

( * ) Notice: Subject to any disclaimer, the term of this patent is extended or adjusted under 35 U.S.C. 154(b) by 0 days.

(21) Appl. No.: 11/728,018

(22) Filed: Mar. 23, 2007

(51) Int. Cl.
*B63B 17/00* (2006.01)

(52) U.S. Cl. ..... 114/343; 114/364; 362/431; 362/477; 362/486

(58) Field of Classification Search ..... 114/343, 114/364; 362/431, 477, 486
See application file for complete search history.

(56) References Cited

U.S. PATENT DOCUMENTS

| | | | | |
|---|---|---|---|---|
| 2,797,310 | A | 6/1957 | Moore | |
| 3,021,969 | A | 2/1962 | Peake et al. | |
| 3,044,646 | A | 7/1962 | Sperow | |
| 3,083,292 | A | 3/1963 | Roe et al. | |
| 3,192,376 | A * | 6/1965 | Najimian, Jr. | 362/477 |
| 3,632,138 | A | 1/1972 | Whiteley | |
| 3,788,502 | A | 1/1974 | Bell | |
| 3,833,800 | A | 9/1974 | Stewart et al. | |
| 3,885,146 | A | 5/1975 | Whitley, Jr. | |
| 3,887,093 | A | 6/1975 | Howell | |
| 4,445,163 | A | 4/1984 | Ziaylek, Jr. | |
| 4,884,173 | A * | 11/1989 | Cassidy | 362/477 |
| 5,335,149 | A * | 8/1994 | Evans | 362/477 |
| 5,544,022 | A * | 8/1996 | Blackard | 362/477 |
| 5,725,228 | A * | 3/1998 | Livingston | 280/414.1 |
| 7,113,078 | B2 | 9/2006 | Young | |

* cited by examiner

*Primary Examiner*—Sherman Basinger

(57) ABSTRACT

Transom lights for boats are easily attached before the boat is towed on a trailer. Each light includes a housing attached to a post, a major lens and a minor lens. The transom light circuitry is connected to the electrical circuitry of the towing vehicle. The housing is rigidly affixed to the post and in an alternate form the housing is pivotable to better conform to the shape of the transom. A socket can be readily attached to the transom for slidably receiving the post. Before the boat is placed in the water the transom lights are disconnected and removed.

16 Claims, 5 Drawing Sheets

REMOVABLE TRANSOM LIGHTS

FIELD OF THE INVENTION

The invention herein pertains to safety lights for releasable attachment to a boat transom and particularly pertains to lights for use while towing a boat along a road or highway.

DESCRIPTION OF THE PRIOR ART AND OBJECTIVES OF THE INVENTION

Owners of small boats frequently transport their boats to and from lakes, rivers, oceans and other locations. Generally a trailer is used which is coupled to the rear of a towing vehicle such as a pickup truck. Trailers are usually equipped with rear safety and brake lights which can be easily connected to the electrical system of the towing vehicle to provide brake and warning lights to following motorists. Such trailer lights are generally mounted beneath the trailer and with a boat placed on the trailer, the lights are sometimes difficult for following motorists to see. Also, the trailer lights are generally submerged in water as the boat owner launches or loads the boat at a water site. Water can infiltrate the trailer lights, causing them to fail. Most states require boat trailers to incorporate rear brake and warning lights and should the lights fail due to water infiltration or other causes, the trailer cannot be towed along a highway or road until the lights are repaired. Also most trailer lights are best seen from behind the trailer, causing motorists approaching the trailer from a side road to possibly lose vision of the trailer and accidentally collide with it.

Thus with the disadvantages and problems associated with conventional rear trailer brake and warning lights, the present invention was conceived and one of its objectives is to provide a transom light which can be easily affixed and removed from the transom of a towed boat for road towing by a relatively unskilled user.

It is another objective of the present invention to provide transom light circuitry which provides the boat owner with added safety and convenience.

It is still another objective of the present invention to provide a method of use whereby the transom light circuitry can be quickly installed on a boat before towing and readily removed before launching.

It is a further objective of the present invention to provide a transom light socket which allows for easy installation and reception of a releasable transom light.

Various other objectives and advantages of the present invention will become apparent to those skilled in the art as a more detailed description is set forth below.

SUMMARY OF THE INVENTION

The aforesaid and other objectives are realized by providing a transom light which is removably attached to a channeled socket on a boat transom. Generally, a left and right transom light will be attached to the electrical circuitry of the towing vehicle by the use of a t-connector. The t-connector is joined to the standard trailer brake light circuitry and also joined to the existing truck circuitry. Once the circuit connections have been made, application of the brakes by the vehicle driver will cause both the standard trailer brake lights and the removable transom brake lights to operate. During levels of low, ambient light the truck driver can turn on the truck lights which in turn will illuminate both the trailer lights and the transom lights. When the vehicle brakes are applied both the transom brake lights and the trailer brake lights additionally warn following motorists. Each transom light includes a rigid housing which may be molded from plastic and which is covered with a red transparent lens, encasing light bulbs, LED's or the like which are joined to the removable transom light electrical circuitry. A minor lens is positioned normally to a major lens on each side of the transom to provide a warning to motorists which approach the trailer from the side. One form of the transom light housing includes a pivotable joint to allow the housing to rotate relative to a post for better conformity to certain boat transoms. In use a socket for the post is attached such as by threaded fasteners to the boat transom. The socket includes a central channel to allow the transom light post to easily, releasably engage the socket. The post is positioned at an angle from the housing for easy insertion and to prevent disengagement such as when the trailer is towed over uneven terrain. An elastic member helps secure the transom light to the socket.

In the method of use, the transom lights sockets are attached to the transom in the desired locations. As needed the boat is positioned on the trailer and the trailer coupled to the towing vehicle as usual. Next, the transom light posts are slidably mounted in the attached sockets. The transom light circuitry affixed to the transom lights is then positioned in the boat and the t-connector is attached to the trailer light circuitry. Thereafter the t-connector is connected to the towing vehicle circuitry. The transom safety and brake lights are then tested. If the transom lights are in workable order the boat is ready for towing over the road.

DETAILED DESCRIPTION OF THE PREFERRED EMBODIMENT AND OPERATION OF THE INVENTION

Figure 1:
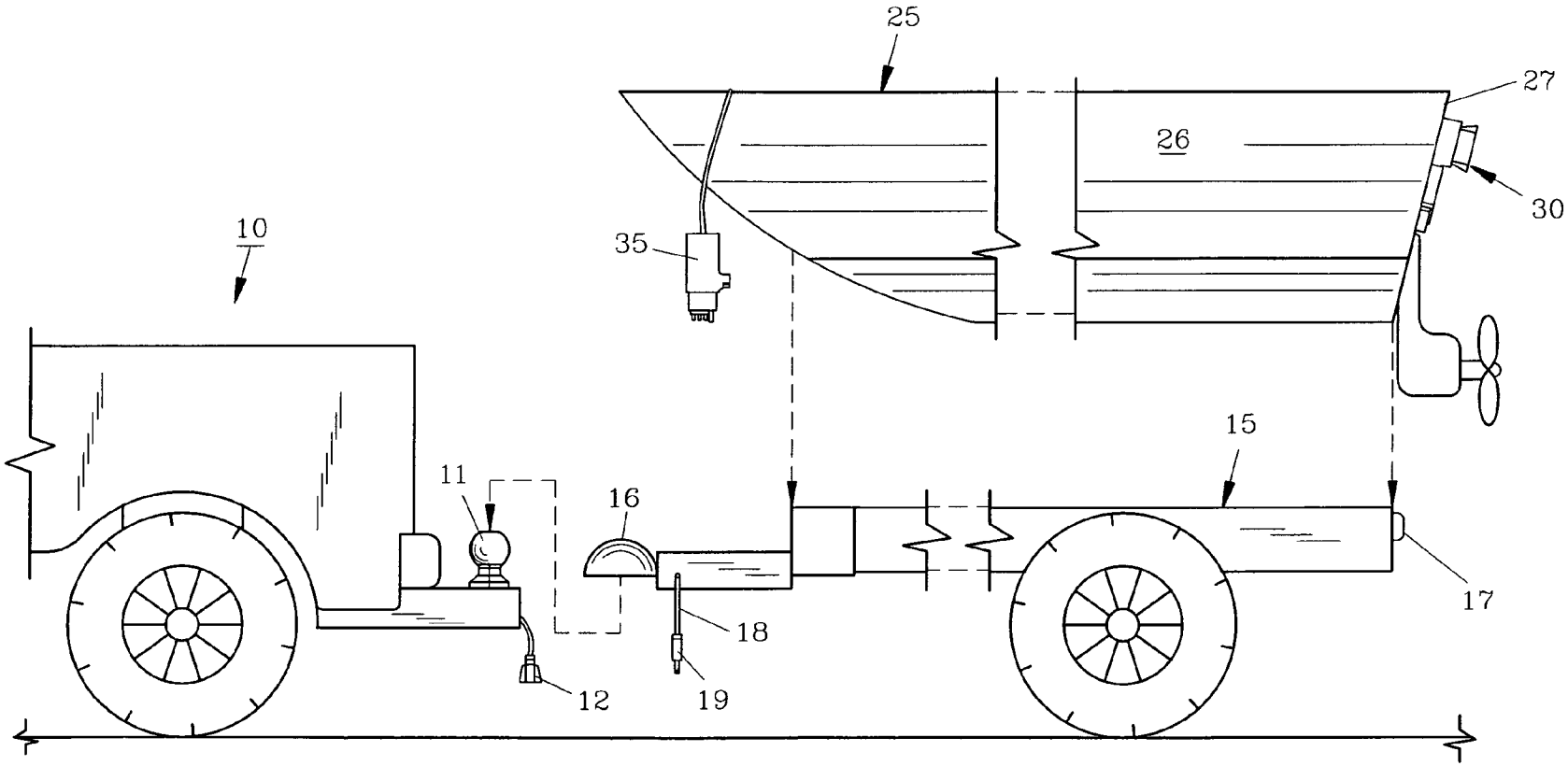
FIG. 1 illustrates a conventional boat and trailer in abbreviated form with the removable transom lights of the invention affixed to the boat with the transom lights and trailer lights disconnected.
Figure 4:
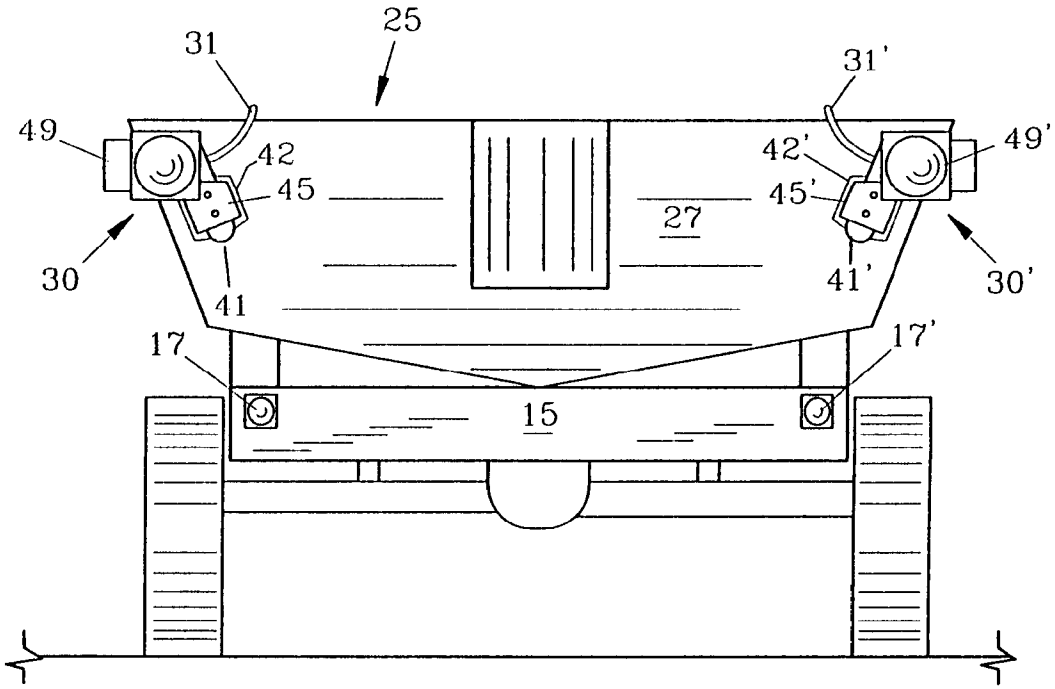
FIG. 4 depicts a rear view of a boat shown in FIG. 1 but without the motor positioned on the trailer and with the transom lights installed.

For a better understanding of the invention and its operation, turning now to the drawings, FIG. 1 demonstrates in exploded fashion the rear section of typical pickup truck 10. Pickup truck 10 includes a rear trailer hitch 11 with electrical female connector 12 for supplying DC current to conventional boat trailer 15, shown uncoupled from pickup truck 10. Boat trailer 15 includes standard trailer hitch ball 16 for engagement with trailer hitch 11. Trailer 15 also includes usual rear brake lights 17, 17' which are joined to conventional brake light conductor 18 having connector 19 which can be joined to truck connector 12 to operate trailer brake lights 17, 17' when the truck driver (not shown) operates the truck brakes. As would be understood, brake lights 17, 17' are positioned as seen in FIGS. 1 and 4 on each side of trailer 15, below boat 25. Boat 25 is shown exploded from trailer 15 in FIG. 1 and is a conventional small outboard motor type fishing boat having hull 26 and transom 27 (see also FIG. 4). In order to better protect boat 25 from collisions with other vehicles during road towing, and for other purposes herein described, boat 25 is configured with preferred removable left and right transom lights 30, 30' of the invention.

Figure 2:
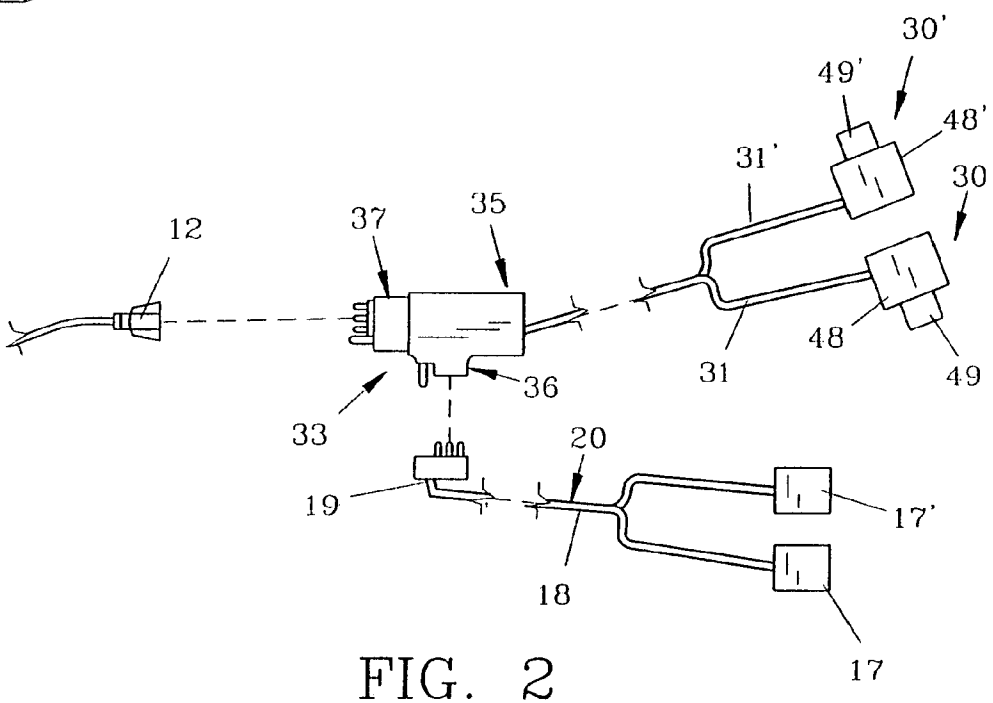
FIG. 2 shows in schematic fashion the transom light circuitry along with conventional trailer light circuitry, both removed from the boat and trailer.
Figure 5:
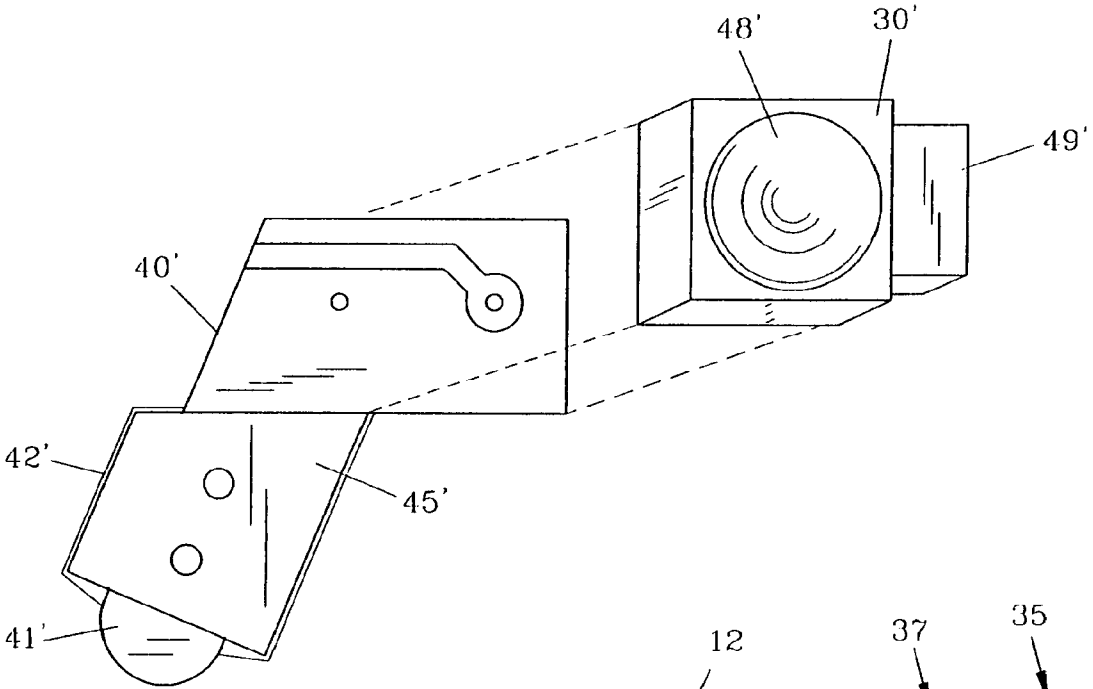
FIG. 5 depicts an embodiment of a right transom light with the lens exploded from the housing.
Figure 3:
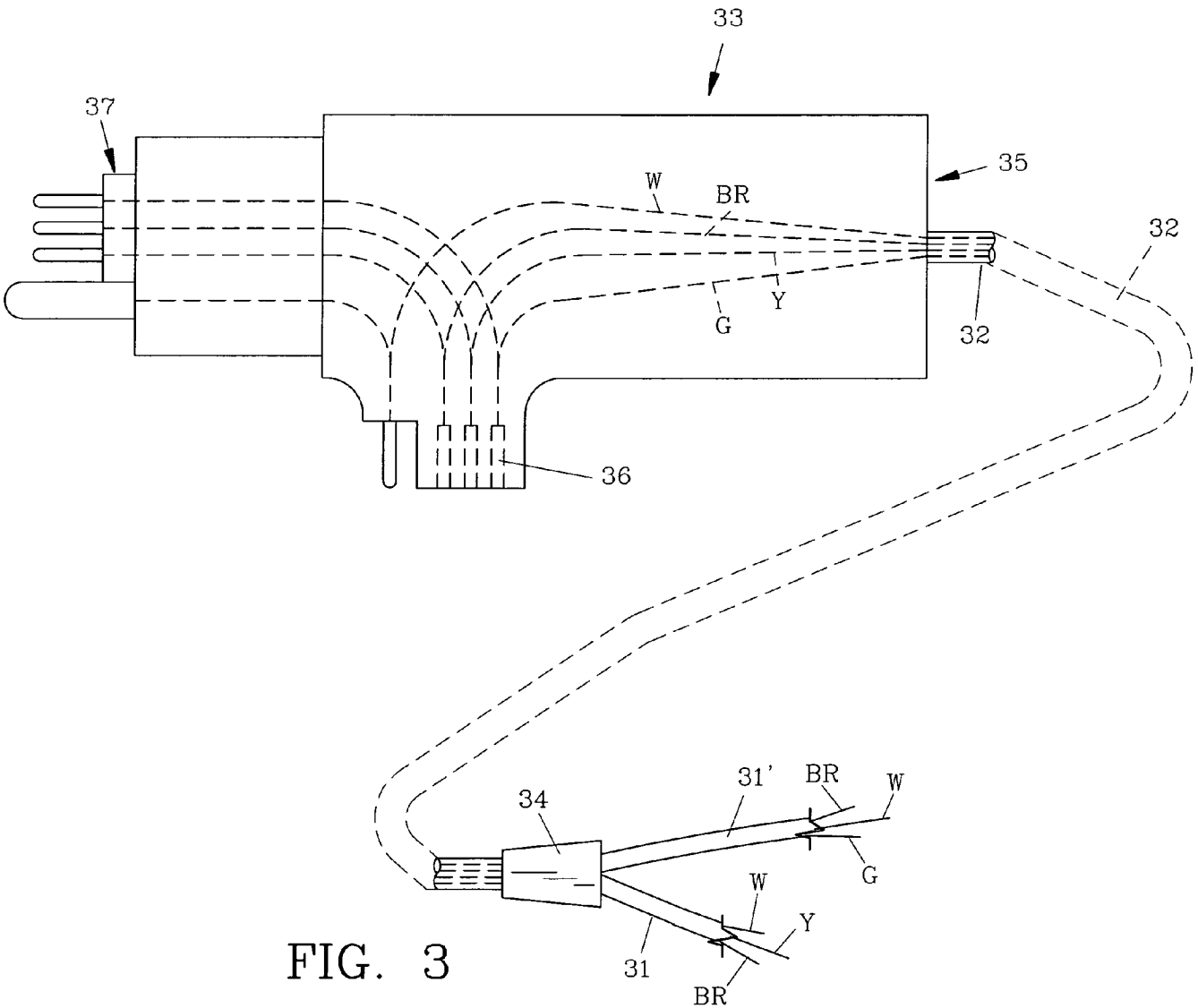
FIG. 3 illustrates an enlarged view of the transom light circuitry in schematic fashion with the t-connector and y-junction.

In FIGS. 2 and 3 conventional trailer light circuitry 20 is shown along novel transom light circuitry 33, both removed from trailer 15 and boat 25 for clarity. In FIG. 5, left transom light 30' is shown having housing 40' formed from a rigid plastic with post 41' attached thereto such as by molding. Post 41' having a planar surface is releasably secured within socket 45' which is fastenable to boat transom 27 as shown in FIG. 4. Conductor 31' is secured to housing 40' and forms an electrical connection with light bulbs or the like (not seen) housed within major lens 48' and minor lens 49'. Minor lens 49' provides safety side illumination for boat hull 26. Transom lights 30, 30' are lit for night towing and provides an additional light source of illumination when the driver of truck 10 applies brakes to warn following vehicles.

Figure 7:
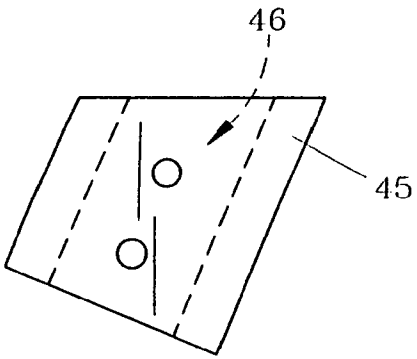
FIG. 7 pictures a front view of the transom light socket as removed from the transom.
Figure 7A:
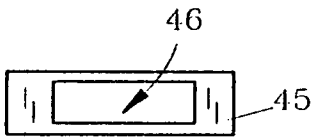
FIG. 7A illustrates the socket seen in FIG. 7 in a top plan view.

In the method of use, post 41 (FIGS. 4 and 5) is placed within rectangular slot 46 (shown in FIGS. 7 and 7A) of socket 45 and elastic member 42 is then stretched around the bottom of post 41 and positioned over socket 45 as seen in FIG. 4. As would be understood the same would be performed for transom light 30' with post 41'. Elastic member 42 along with the angular configuration of post 41 prevents transom light 30 from bouncing and inadvertently disengaging from socket 45, such as may occur when boat 25 is driven over rough terrain. A side view of socket 45 is seen in FIG. 7 and a top view of slot 46 is seen in FIG. 7A. In another embodiment shown in FIG. 6, alternate transom light 50 includes a pivotable joint 51 which allows housing 53 to rotate along its horizontal axis relative to post 52 shown in FIG. 6A.

Figure 6:
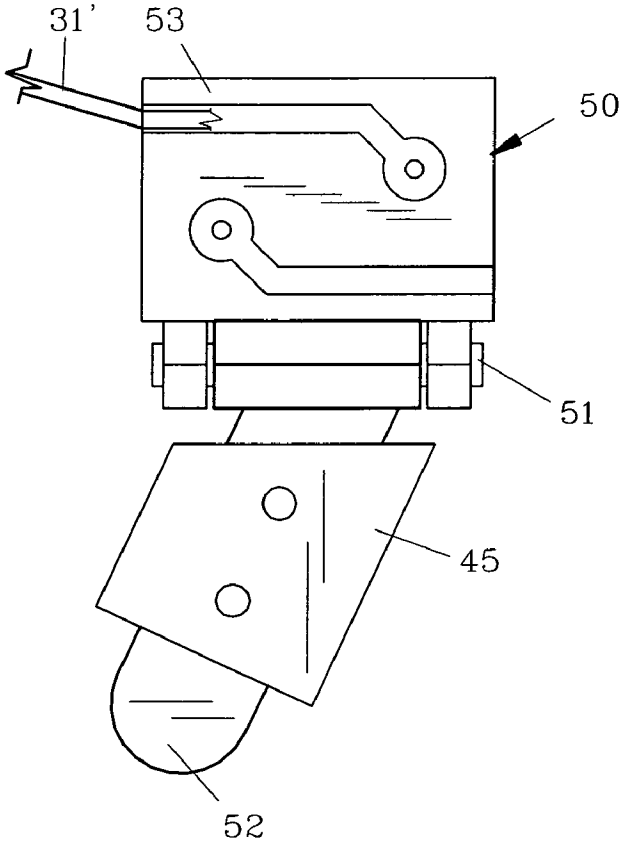
FIG. 6 features another embodiment of the transom light of that shown in FIG. 5 with the lens exploded therefrom.
Figure 6A:
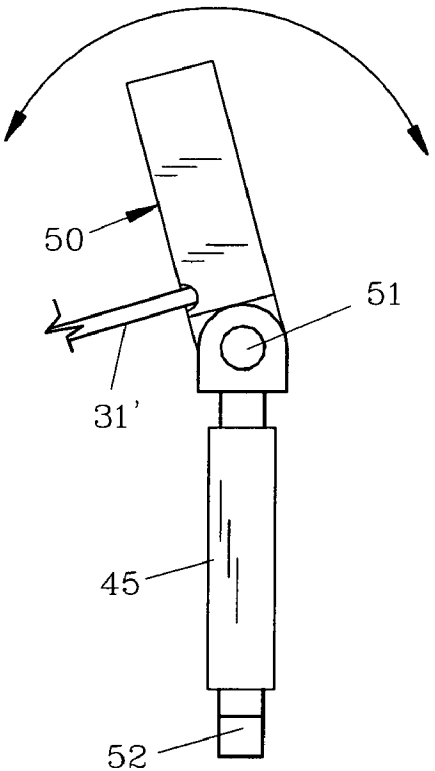
FIG. 6A demonstrates the pivoting of the transom light housing as seen in FIG. 6.

Major lens 48 and minor lens 49 are likewise affixed to housing 53 as seen in FIG. 6 and post 52 is inserted into socket 45 similar to the connection of transom lights 30, 30' seen in FIG. 4. Major lens 48 is mounted normal to minor lens 49 to provide safety illumination to vehicles approaching from the side. Pivotable connection 51 allows transom light 50 to be adjusted, depending on the angle of transom 27. As would be understood, various boat transoms vary in (vertical) angular displacement as shown in FIG. 1 with transom 27.

As seen in FIG. 3, t-shaped connector 35 is shown joined to main conductor 32 of transom light circuitry 33. Also, in the method of use truck terminal 37 of connector 35 is joined to truck DC connector 12 as seen in FIG. 1 and terminal 36 is joined to standard trailer brake light connector 19. Thus, t-connector 35 allows electricity to flow from truck 10 to brake lights 17, 17' and to transom lights 30, 30'. Y-junction 34 splits main conductor 32 for attachment to transom light conductors 31, 31'.

The illustrations and examples provided herein are for explanatory purposes and are not intended to limit the scope of the appended claims.

I claim:

1. A quickly releasable transom light comprising: a socket, said socket positioned on a boat transom, said socket defining a channel, a light housing, a post, said post defining a planar surface, said post affixed to said light housing and positioned in said socket, a conductor, said conductor joined to said light housing and a pair of terminals, a connector, one of said pair of terminals for connection to a trailer brake light connector, said pair of terminals joined to said conductor.

2. The transom light of claim 1 wherein said light housing is horizontally, pivotally joined to said post.

3. The transom light of claim 1 further comprising an elastic member, said elastic member attached to said light housing.

4. The transom light of claim 1 further comprising a major lens and a minor lens, said major lens angularly joined to said minor lens, said major lens attached to said light housing.

5. The transom light of claim 4 wherein said major lens is joined in normal relation to said minor lens.

6. The transom light of claim 1 further comprising a y-junction, said y-junction joined to said conductor.

7. Transom lights for quick connection to the brake lights of a boat trailer for use while towing a boat thereon comprising: a left socket, a right socket, said left and right sockets for mounting on a boat transom, said left and right sockets each defining a channel, a left light housing, a right light housing, a left post, a right post, said left post and said right post each defining a planar surface, said left post attached to said left light housing and said right post attached to said right light housing, said left post positioned in said left socket channel and said right post positioned in said right socket channel, a left conductor, said left conductor attached to said left light housing, a right conductor, said right conductor attached to said right light housing, a y-junction, said left conductor and said right conductor each joined to said y-junction, a main conductor, said main conductor attached to a connector and to said y-junction, and a pair of terminals, said pair of terminals joined to said connector, said connector for attaching to a power source.

8. The transom lights of claim 7 wherein said left light housing is pivotally joined to said left post.

9. The transom lights of claim 7 wherein said right light housing is pivotally joined to said right post.

10. The transom lights of claim 7 wherein one of said pair of terminals is connectable to a power source and the other of said pair of terminals is connectable to a transom light circuit.

11. The transom lights of claim 7 wherein said connector is t-shaped, a pair of elastic members, said elastic members affixed to said left light housing and to said right light housing to maintain said housing in contact with said sockets.

12. The transom lights of claim 7 wherein said main conductor comprises a sheath, a plurality of wires, said plurality of wires contained within said sheath.

13. The transom lights of claim 7 wherein one of said plurality of wires comprises a ground.

14. The transom lights of claim 7 further comprising a left major lens and a right major lens, said left major lens affixed to said left light housing and said right major lens affixed to said right light housing.

15. A quickly releasable boat transom light for use while towing a boat along a road with a vehicle, the vehicle including electrical circuitry for connection to the boat transom light, comprising: a housing, said housing containing a light, a post, said post having a rectangular cross section, a socket, said socket defining a rectangular channel, said post releasably positioned in said channel, an elastic member, said elastic member affixed to said housing for positioning on said socket, said post attached to said housing, said post angularly depending from said housing, transom light circuitry, said transom light circuitry connected to said housing for connection to said vehicle electrical circuitry.

16. The transom light of claim 15 wherein said angular dependency forms an obtuse angle between said housing and said post.

* * * * *